US005451078A

United States Patent [19]

Ohata

[11] Patent Number: 5,451,078

[45] Date of Patent: Sep. 19, 1995

[54] WINDSKIING APPARATUS

[76] Inventor: Michael L. A. Ohata, P.O. Box 1117, Merritt, British Columbia, Canada, V0K 2B0

[21] Appl. No.: 149,734

[22] Filed: Nov. 10, 1993

[51] Int. Cl.[6] ..... A63C 11/00

[52] U.S. Cl. ..... 280/810; 280/816; 114/39.2

[58] Field of Search ..... 280/809, 810, 816, 817, 280/818; 441/73, 74; 114/39.1, 39.2

[56] References Cited

U.S. PATENT DOCUMENTS

| | | | |
|---|---|---|---|
| 4,204,694 | 5/1980 | Freeman | 280/810 |
| 4,234,211 | 11/1980 | Lux | 280/810 |
| 4,489,957 | 12/1984 | Holmgren | 280/810 |
| 4,533,159 | 8/1985 | Seidel | 280/810 |
| 4,534,305 | 8/1985 | Lecomte | 441/73 |

FOREIGN PATENT DOCUMENTS 3506609 9/1985 Germany .

*Primary Examiner*—Richard M. Camby
*Attorney, Agent, or Firm*—Bull, Housser & Tupper

[57] ABSTRACT

The invention provides an apparatus for resiliently securing a pair of skis together in generally parallel relationship, and for receiving a sail rig as commonly used on a conventional sailboard, to permit conventional snow skis to be used in a manner similar to a sailboard. The apparatus comprises a cross piece to extend transversely between the skis, with a central portion of the cross piece connected to the sail assembly. Ski connectors connect each ski to respective opposite end portions of the cross piece. Each ski connector has at least one resilient flexible link, and at least one pair of anchors for anchoring the flexible link to respective end portions of the cross piece, and for preventing gross movement of the flexible link as a whole. The link extends between the anchors and is engageable with a projection on the ski. The link passes around the projection to draw the projection resiliently against the respective end portion of the cross piece. Resilience in the connection permits limited rotation of the ski relative to the cross piece about a longitudinal ski axis of each ski, and about a yaw axis of each ski disposed perpendicularly to a base of the respective ski. The projection can be a support releasably attachable to the ski at a selection of locations, or a specific type of conventional ski binding toe piece.

20 Claims, 6 Drawing Sheets

WINDSKIING APPARATUS

BACKGROUND OF THE INVENTION

The invention relates to an attachment for snow skis which receives a sail assembly or sail rig as used in sailboarding, to permit snow skis to be used for wind skiing.

Board sailing is a popular sport which permits a modified surfboard to be wind driven by using a manually supported sail assembly or sail rig, which is releasably connected and freely-jointed to the board. It is known to provide an attachment which interconnects a pair of snow skis and receives a conventional sail assembly or sail rig as used in sailboarding to permit wind skiing over snow. An example of such an attachment is shown in German patent publication DE 3506-609-A, filed in the name of Mistral Windsurfing. This publication discloses a cross-beam interconnecting a pair of skis, the cross-beam having a mast socket to receive the sailing assembly. The invention provides a structure which maintains the skis at equal distances from the mast socket, while permitting spacing between the skis to vary. This structure permits use of standard ski bindings already fitted on the skis, but requires a relatively complex attachment using a moving looped cable and slider structure to maintain the skis at equal distances from the mask socket.

Other devices that permit use of a sail rig with snow skis are shown in U.S. Pat. Nos. 4,534,305 (Lecomte), 4,234,211 (Lux), 4,204,694 (Freeman), and 4,533,159 (Seidel). Some of these devices require special attachments that are permanently secured to the skis to permit attachment to a mast support, while others show a mast mounted on one ski only or show specially designed skis. U.S. Pat. No. 4,489,957 (Holmgren) discloses an attachment which permits an ice skater to use a sail for wind sailing with ice skates.

None of the devices known to the applicant has a lightweight, mechanically simple structure which is easy to install on, and remove from, conventional skis, so as to permit the skis to be used for normal downhill skiing. In addition, none of the devices discloses a structure which provides easily adjustable self-centering forces which assist the skier in returning the skis to a "flat" condition, i.e. with flat or coplanar ski bases, with the skis parallel.

SUMMARY OF THE INVENTION

The invention reduces the difficulties and disadvantages of the prior art by providing an attachment for snow skis which requires none, or at least minimal, connecting means to be fastened permanently on the skis, and also permits easy removal of the attachment from the skis so that the skis could be used for normal downhill skiing. In addition, the device is mechanically simple, lightweight and provides an easily adjustable "self-centering" structure which assist the skier in returning to a "neutral configuration" i.e. with ski bases parallel to each other, i.e. "flat", and skis parallel The invention is adaptable to receive a conventional U-joint of a prior art sail boarding sail assembly or sail rig, and provides incremental adjustment for repositioning location of the sailboarding mast with respect to length of the skis. Also, the apparatus provides a means to vary spacing between the skis, which permits easy adjustment of the skier's stance to personal preference.

An apparatus according to the invention is for securing to a pair of skis and comprises a cross piece and ski connecting means. The cross piece extends transversely between the pair of skis which are disposed generally parallel to and spaced apart from a main longitudinal axis. The cross piece has a central portion disposed between a pair of opposite end portions, the central portion having sail connecting means for connecting to a sail assembly. Each ski connecting means is for connecting a respective ski to a respective opposite end portion of the cross piece and comprises at least one resilient flexible link and at least one pair of anchoring means. The anchoring means is for anchoring the flexible link to the respective end portion of the cross piece and prevents gross movement of the flexible link as a whole. The flexible link of each connecting means extends between the anchoring means and is engageable with a respective projection extending from a respective ski. The flexible link passes around the projection to draw the projection resiliently against the respective end portion of the cross piece, while permitting limited rotation relative to the cross piece about a longitudinal ski axis of each ski, and about a yaw axis of each ski disposed perpendicularly to a base of the respective ski.

Preferably, each ski connecting means further comprises a first centering means for resiliently urging each ski to a first neutral configuration thereof with respect to the cross piece, in which the bases of the skis are disposed generally within a common neutral plane. Also, preferably, each ski connecting means comprises a second centering means for resiliently urging each ski to a second neutral configuration thereof in which the skis are disposed parallel to each other and perpendicularly to the cross piece. Also, a portion of the flexible link of each connecting means extends generally transversely of the ski.

Preferably, each ski is fitted with a supporting means for supporting the cross piece on the respective ski to serve as the aforesaid projection extending from the respective ski. The supporting means has a link clearance to receive the flexible tension link passing therethrough generally transversely of the longitudinal axis of the respective ski. Alternatively, in its simplest form, the apparatus can be used with an existing pair of skis having suitably designed toe pieces which serve as the projection extending from the respective ski, and with such an arrangement, no additional attachments are required to be secured to the ski.

A detailed disclosure following, related to drawings, describes a preferred embodiment of the invention which is capable of expression in structure other than that particularly described and illustrated.

BRIEF DESCRIPTION OF THE DRAWINGS

In drawings which illustrate an example of the invention.

DETAILED DESCRIPTION

FIG. 1

Figure 1:
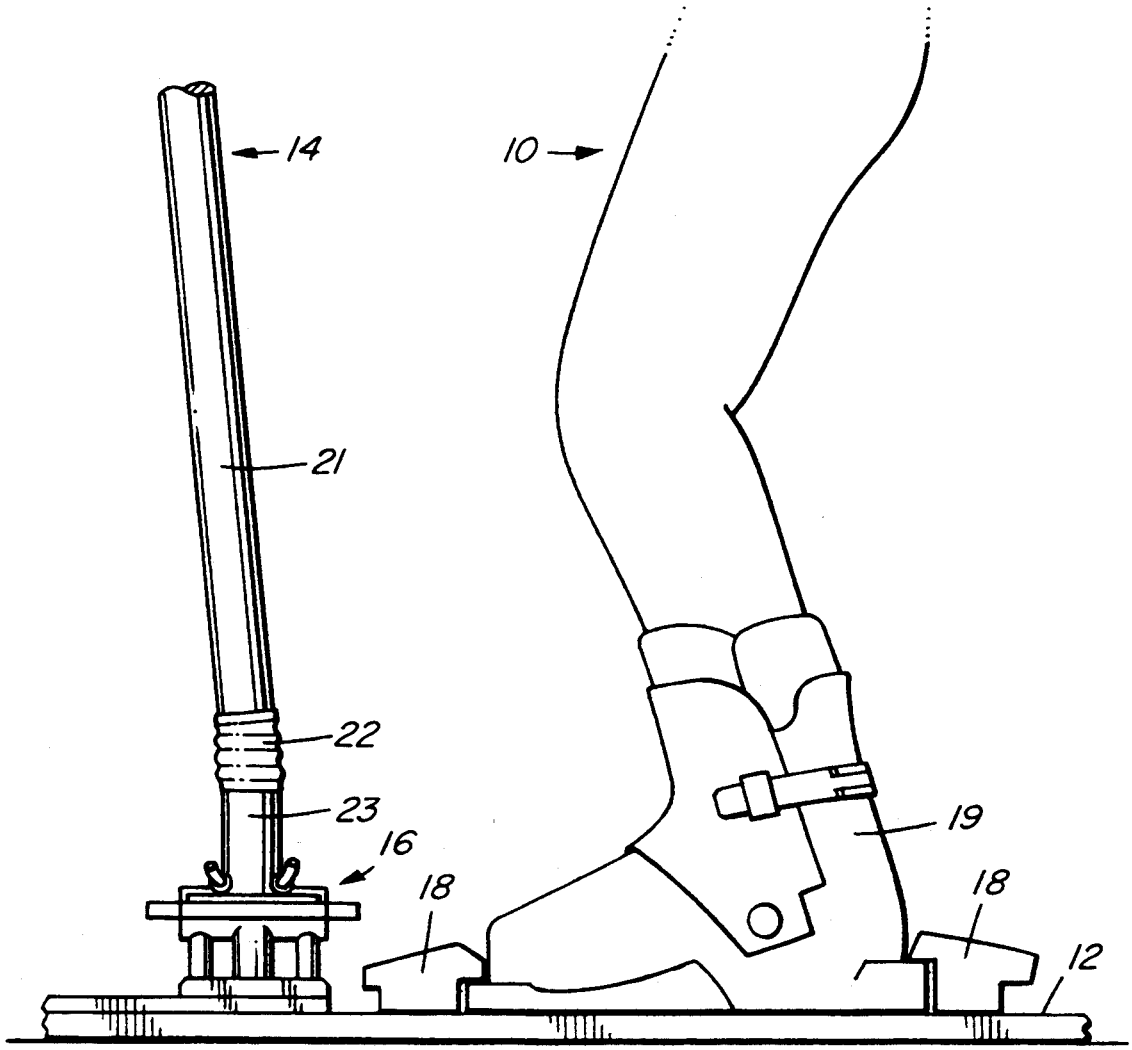
FIG. 1 is a fragmented side view of a skier on a pair of skis fitted with an attachment according to the invention, and supporting a conventional sail assembly as commonly used on a sailboard.

A portion of a skier 10 is shown standing on a pair of skis 12, hands of the skier (not shown) supporting a conventional sailboarding sail rig or sail assembly 14 in a conventional manner, the rig being carried on the skis by an apparatus 16 according to the invention. The skis are fitted with conventional ski bindings 18 which receive conventional ski boots 19 worn by the skier. The sail rig 14 has a mast 21 fitted with a universal joint 22 having a universal joint base 23 extending downwardly from the universal joint, and being received by the apparatus 16. This permits the well known, essentially unrestricted or universal movement of the mast 21 with respect to the apparatus 16, as if the apparatus were a sailboard.

Figure 2:
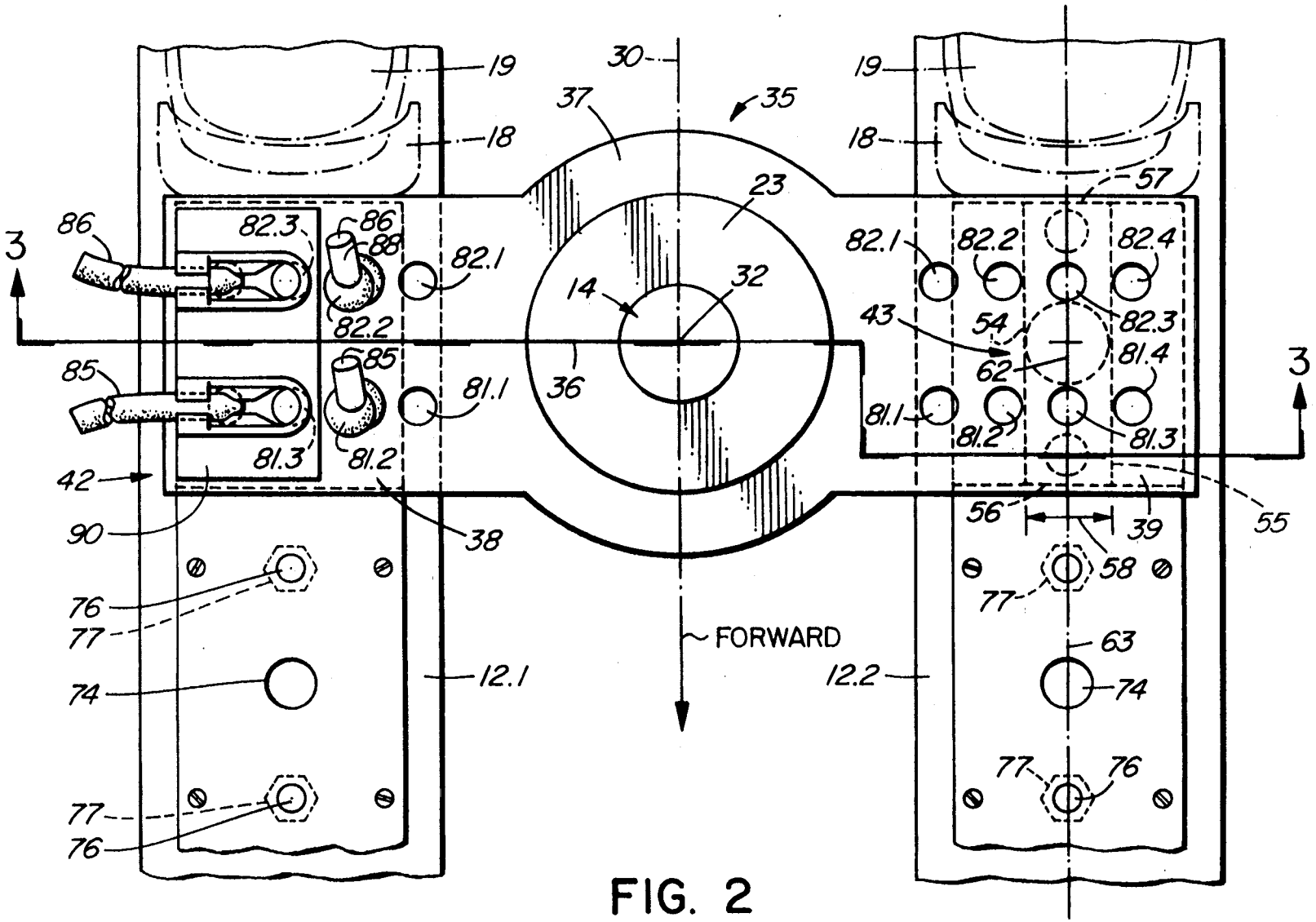
FIG. 2 is a simplified fragmented top plan of portions of a pair of skis with an apparatus according to the invention shown extending between the skis, some portions being omitted for clarity.
Figure 3:
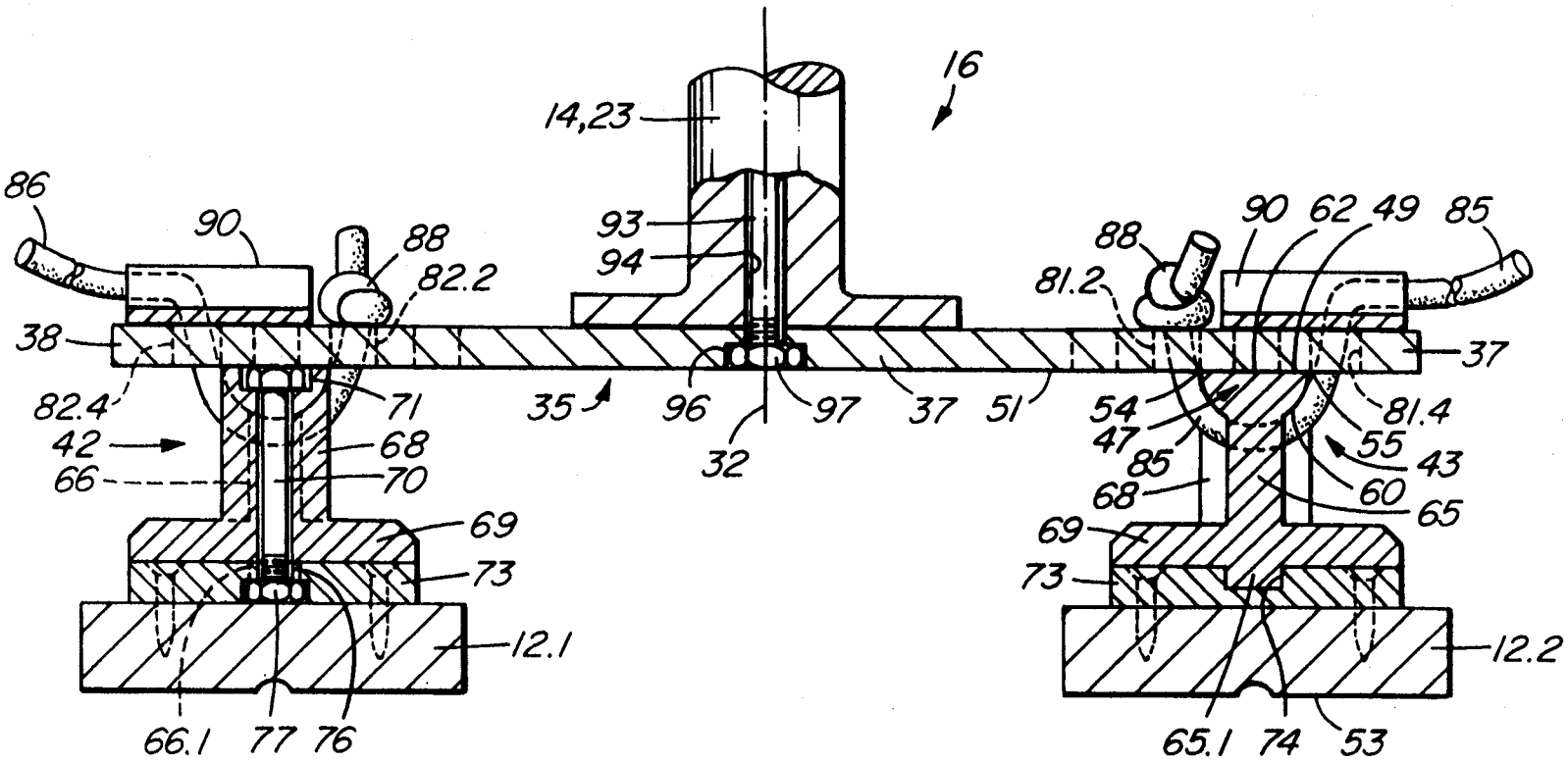
FIG. 3 is a simplified fragmented section generally on Line 3—3 of FIG. 2, some portions being omitted.
Figure 4:
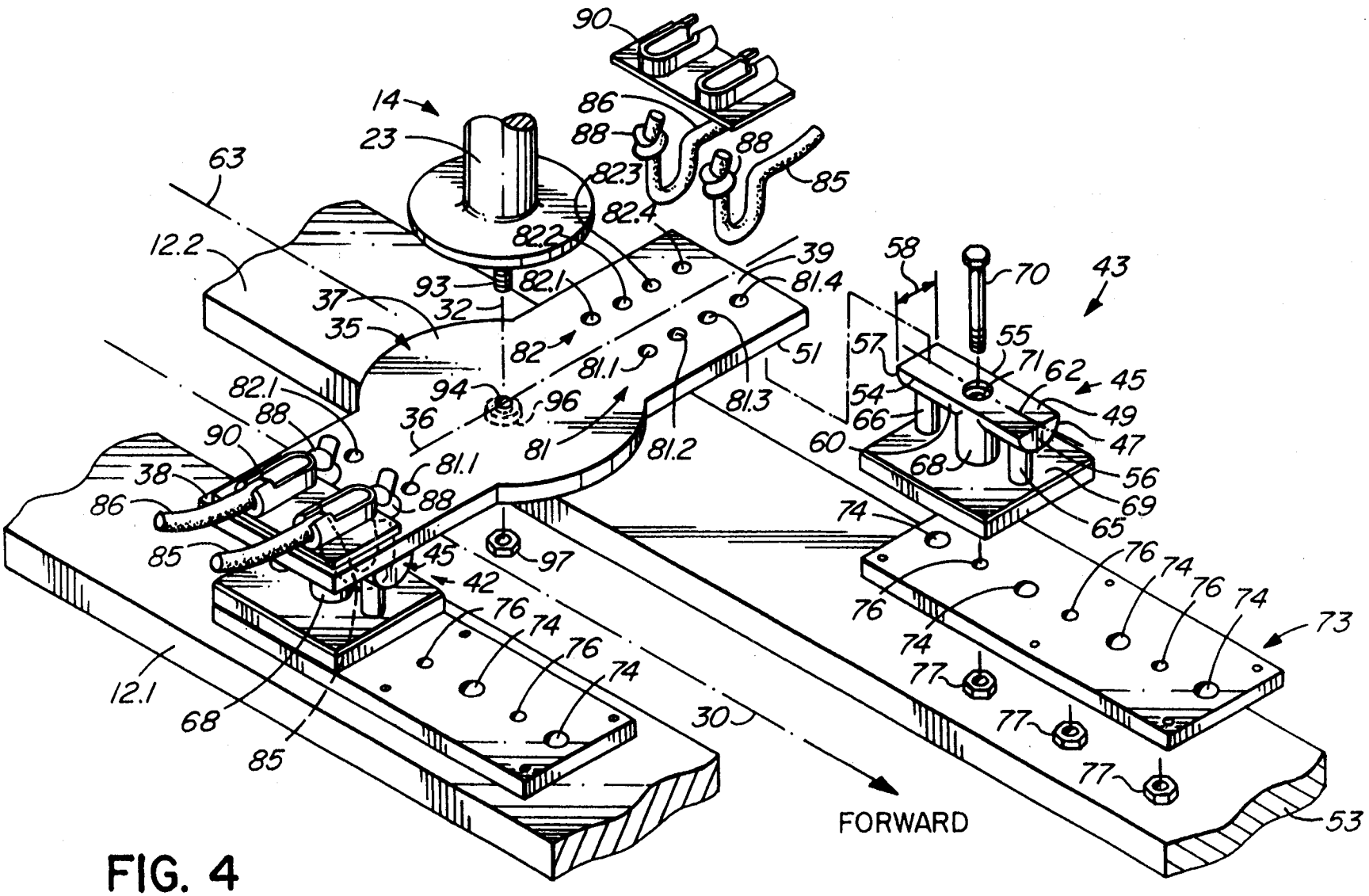
FIG. 4 is a simplified, partially fragmented and partially "exploded" perspective of portions of the apparatus and portions of the ski, ski bindings being omitted.

FIGS. 2 through 4

Referring to FIG. 2, right-hand and left-hand skis 12.1 and 12.2 respectively of the pair of skis are disposed generally parallel to, and spaced apart equally from a main longitudinal axis 30 of the apparatus. The axis 30 is aligned with a generally forward direction and is intersected by a generally vertical base axis 32 of the sail rig 14. Toes of right-hand and left-hand boots 19 are shown in broken outline located by conventional ski bindings be which are spaced aft of the apparatus 16. The apparatus 16 has a cross piece 35 which extends transversely between the pair of skis and has a central portion 37 disposed equally spaced from and between opposite right-hand and left-hand end portions 38 and 39 respectively. The cross piece is an elongated, relatively thick, plate-like member having a main cross piece axis, termed a transverse axis 36, which intersects the main longitudinal axis 30 perpendicularly at the base axis 32. The central portion 37 thereof has a greater width than the end portions and thus is strengthened to resist forces from the sail rig.

Referring to FIGS. 3 and 4, the apparatus 16 further includes generally similar right-hand and left-hand ski connecting means 42 and 43 for connecting each ski to a respective opposite end portion of the cross piece. As the ski connecting means are essentially identical to each other, in FIG. 4, components of the left-hand ski connecting means are shown separated in full detail, and equivalent components of the right-hand ski connecting means are shown connected together. Specific details of the two ski connecting means are shown on opposite sides of FIG. 3.

In FIG. 4, the ski connecting means 43 has a supporting means 45 for supporting the cross piece 35 on the ski 12.2. The supporting means 45 comprises a support body 47 of semi-cylindrical cross-section, with a generally flat, diametrically disposed datum support surface 49 facing upwardly and adapted to contact a lower face 51 of the cross piece. Preferably, when viewed transversely or longitudinally the surface 49 is parallel to a lower surface or ski base 53 of the ski. The datum support surface 49 has generally parallel, axially disposed edges 54 and 55 which extend between forward and aft semicircular end faces 56 and 57 of the support body and define width 58 of the surface 49. The body 47 also includes a semi-cylindrical link surface 60 which is generally concentric with a longitudinally extending support axis 62 which passes symmetrically between the edges 54 and 55 and is coplanar with a longitudinal axis 63 of the ski parallel to the axis 30 (FIG. 2). The link surface is thus curved and extends between the edges of the datum surface to intersect the edges of the datum surface generally perpendicularly as shown.

The supporting means 45 further includes forward and aft pillars 65 and 66 spaced longitudinally along the support body and generally adjacent the end faces 56 and 57, a central pillar 68 disposed between the pillars 65 and 66, and a support base 69. The pillars 65, 66 and 68 are parallel to each other and extend between the body 47 and the base 69 to support the body 47 above the base and provide clearance therebetween. The base 69 has a generally flat lower surface provided with downwardly extending projections 65.1 and 66.1 extending downwardly and axially below the forward and aft pillars 65 and 66 respectively. The central pillar 68 has a central opening to receive a bolt 70 which has a head retained in a recess 71 in the surface 49 so that the bolt head is recessed below the surface 49. A support plate 73 is a generally flat, relatively thin, rectangular plate that is securable to an upper surface of the ski with screws, (shown in broken outline in FIG. 3), passing through a plurality of undesignated openings located along sides and at corners of the plate 73. The plate 73 has a plurality of circular pillar recesses 74 spaced apart along a center line of the plate 73 to receive lower ends of the forward and aft pillars 65 and 66 therein to securely locate opposite ends of the body 47 with respect to the support plate 73.

As best seen in FIG. 4, the plate also has a plurality of axially aligned bolt openings 76, one opening 76 being disposed midway between each pair of pillar recesses 74. Each opening 76 communicates with a recess in a lower surface of the plate 73, the recess accepting a nut 77 (see FIG. 3) which is retained against rotation within the recess and adjacent the ski upper face when the plate is secured to the ski. The nut 77 is complementary to the bolt 70, and the nut and bolt are thus releasable connecting means for the supporting means 45. There are three bolt openings 76 and respective nuts 77 spaced axially along the plate 73 to provide three different locations of the bolt, and thus three different axially spaced positions of the supporting means. The plurality of pillar recesses 74 provide respective locations for the pillar projections 65.1 and 66.1 depending on the location of the bolt 70. Thus, spacing between each recess 74 and an adjacent opening 76 is equal to spacing between the respective pillar 65 or 66, and the pillar 68. The bolt 70 and the nut 77 secure the pillar 68 and thus the supporting means 45 to the support plate 73 at one of three possible locations. The forward and aft pillars 65 and 66 provide additional forward and aft support to the body 47 to resist vertical loads and other forces imposed thereon. It can be seen that the support plate, the nuts 77 and the bolt 70 cooperating with the supporting means 45 provides an adjustment means to permit longitudinal adjustment of the supporting means 45 relative to the ski. The bolt 70 and nuts 77 provide releasable engagement means to permit the supporting means 45 to be located in various positions spaced longitudinally along the ski to suit the skier's preference, or to permit removal of the supporting means from the ski for normal downhill skiing as desired.

The ski connecting means 42 further includes the end portion 39 having forward and aft arrays of openings 81 and 82 respectively, disposed along forward and aft undesignated axes which are parallel to each other and the transverse axis 36 of the cross piece. The openings are designated 81.1, 81.2, etc., and 82.1, 82.2, etc. and are disposed inwardly and outwardly of maximum and minimum spacing respectively of the skis, which is dependent on preference of the skier. Two openings of each array are used as a co-operating pair, and spacing between each co-operating pair of openings is critical. For reasons to be described, the individual openings of each co-operating pair are spaced apart at a distance approximately equal to, but somewhat greater than, the width 58 of the datum surface 49. For adequate lateral adjustability of the ski spacing, pitch of the openings of the array, i.e. space between adjacent openings of an array, is one half of the width 58. Clearly, if no adjustability of ski spacing is required, as a minimum each end portion of the cross piece would require a forward pair of cooperating openings and an aft pair of cooperating openings, openings of each pair being spaced apart approximately at the width 58.

The ski connecting means further includes forward and aft elastic cords 85 and 86 which can be heavy duty bungee cords having a size similar to, and preferably no smaller than, the openings of the arrays 81 and 82. Inner end portions of the cords are provided with knots 88 which serve as first stop means, and outer end portions of the cords are retained in a double opening cleat 90, which releasably and adjustably retains outer end portions of the cords 85 and 86. The cords 85 and 86 each have a sufficient length to pass from the respective knot 88 downwardly through an inner opening of the respective opening array 81 or 82, transversely across and around the link surface 60 of the support body 47, and upwardly through an outer opening of the opening array 81 or 82, and through the cleat 90, with sufficient length extending from the cleat for the skier to grasp to permit adjustment of tension of the cord. In this instance the skis are set at maximum stance width, and the inner openings are 81.2 and 82.2, and the outer openings are 81.4 and 82.4. The openings 81.3 and 82.3 are within a vertical plane containing the axes 62 and 63.

While the elastic cords 85 and 86 are preferably bungee cords, other flexible resilient links capable of sustaining tension could be substituted, for example relatively elastic synthetic threads fabricated into cords which can apply sufficient tension to provide centering forces between the cross piece and support means 45 as will be described. Hereinafter and in the claims, the cords 85 and 86 can be referred to as resilient flexible links and include all suitable material.

When the supporting means 45 is secured to the end portion 39 of the cross piece, it can be seen that the end portion 39 has a first link opening, e.g. 81.2 to receive the cord 85 passing therethrough. A first end portion of the link has a first stop, namely the knot 88 which, is prevented from passing through the first link opening 81.2. The end portion of the cross member has a second link opening, for example the opening 81.4, which receives an opposite second end portion of the cord 85. Link retaining means, namely the cleat 90, releasably retains the second end portion of the link to permit adjustment of tension of the link. Tension in the link holds the cleat 90 against the second end portion 39 adjacent the second link opening. While the link retaining means is shown to be the double opening cleat 90, individual cleats, elastic cords locks or other structure which interferes with the second link end portion to releasably retain the link thereagainst can be substituted. The openings 81.2 and 81.4 in the plate, together with the knot 88 and cleat 90, serve as a pair of anchoring means for anchoring the flexible link to the respective end portion of the cross piece to prevent slippage of both end portions of the link, and thus for preventing gross movement of the flexible link as a whole. The aft elastic cord 86 functions similarly with the aft openings 82.2 and 82.4 of the array 82. In FIG. 4, it can be seen that a plurality of openings in the end portion of the cross piece are disposed longitudinally and transversely of the main longitudinal axis, i.e. with respect to the skis, to permit lateral movement of the anchor means with respect to the main longitudinal axis, so as to adjust spacing between the skis with respect to each other. While two separate cords 85 and 86 are shown for ease of tension adjustment, one single length of cord could be substituted. If required, a pair of spaced knots could be positioned on the cord to serve as first stops to engage the first openings of the cross piece. Whether one or two pieces of cord are used for each end portion, a portion of flexible link extends generally transversely between each cooperating pair of openings and the anchoring means associated with each pair.

Referring to FIG. 3, the joint base 23 of the sail rig has a fixed threaded shaft 93 extending downwardly therefrom along the axis 32 to pass into a central opening 94 in the cross piece 35 located at the intersection of the axes 30 and 36. Thus, the shaft 93 passes through the centre of the central portion 37, and is centrally located between the ski connecting means 42 and 43. A recess 96 communicates with the central opening 94 and is provided in the lower face 51 of the cross piece and receives a nut 97 to releasably engage the end of the shaft 93. The nut is retained in the recess and is restricted against rotation to permit the operator to easily connect and disconnect the base, and thus the mast from the cross piece, without requiring tools. It can be seen that the connection of the mast to the cross piece 35 is generally similar to the prior art means of connecting a universal joint base of a sail rig to a sailboard. Thus the nut 97 and the shaft 93 secure the base 23 to the cross piece to transfer force to the skis and to resist axial movement of the base with respect to the cross piece.

The cross piece 35 and the surface 49 of the support body 47 are held in close contact by the tension in the cords 85 and 86. Preferably the body and cross piece are made from a strong, lightweight, low friction material such as high density polyethylene or other UHMW polymers.

OPERATION

Figure 5:
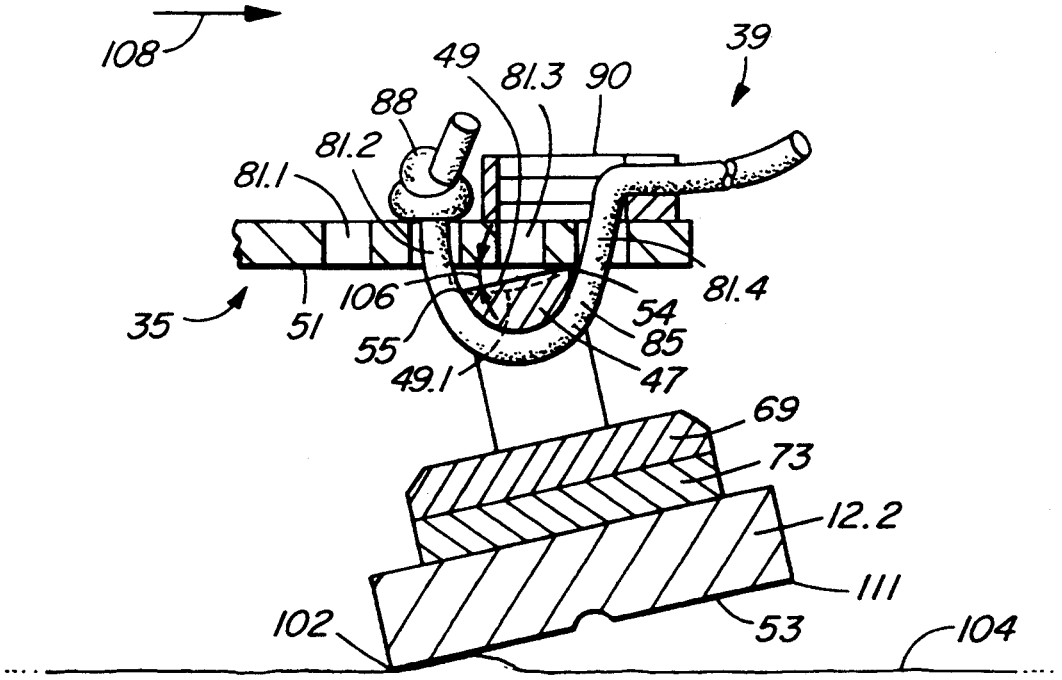
FIG. 5 is a simplified fragmented diagrammatic section generally similar to a portion of FIG. 3, showing one ski "edged", i.e. rotated horizontally with respect to the apparatus and inclined to a snow surface.
Figure 6:
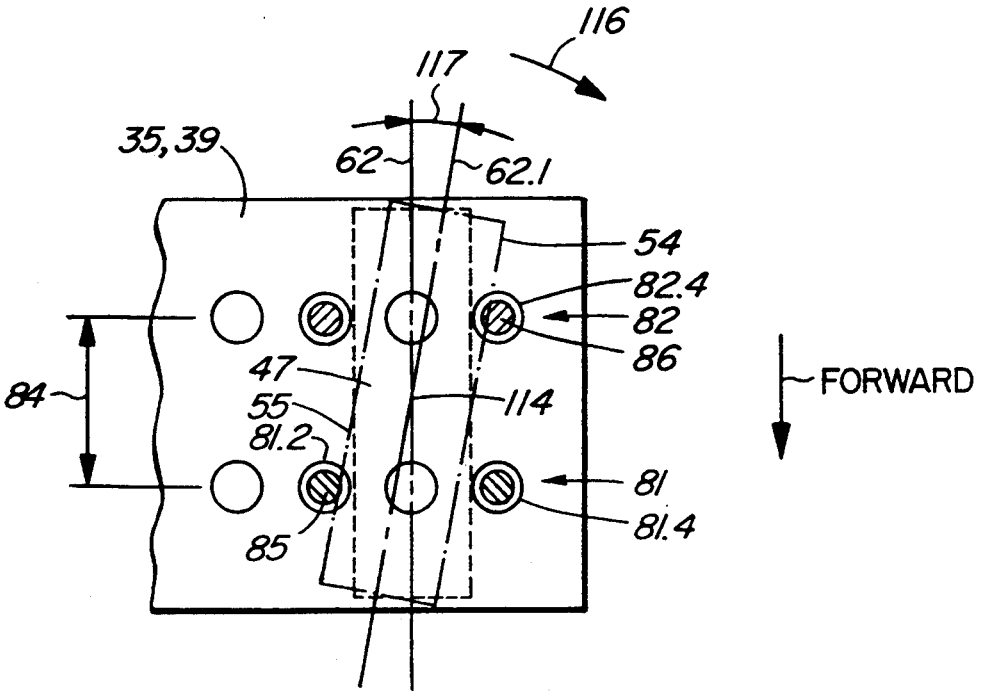
FIG. 6 is a simplified fragmented diagrammatic top plan generally similar to a portion of FIG. 2, showing one ski "turned" or swivelled, i.e. swung about a vertical yaw axis with respect to the apparatus.

FIGS. 1, 5 and 6

The apparatus 16 can be easily mounted on the pair of downhill skis 12, and easily removed therefrom to permit normal downhill skiing without inconvenience. The only structure that is usually retained on the skis during normal downhill skiing is the respective support plate 73, which is mounted forwardly of the toe piece, and is lightweight and relatively thin and thus interferes minimally with normal skiing. Location of the supporting means 45 with respect to the toe piece depends upon personal preference, and, thus the plate 73 permits incremental longitudinal adjustment of the location of the means 45 with respect to the toe piece. While the longitudinal adjustment is not essential, it is preferred as the location of the supporting means 45 determines, indirectly, location of the mast 14. As is well known in the art of sailboarding, longitudinal position of the mast in the board, or in this case on the skis, determines response and directional stability of the completed assembly. In general, the support plate 73 is mounted at a spacing from the toe piece dependent on length of the skis, size of the sail commonly used, and personal sailing style of the skier. The plate 73 is secured with the plurality of screws centrally of the upper surface of the ski so that a central bolt opening 76 is a preferred position of the mast. This provides incremental adjustment, forward and aft of the preferred position to accommodate the skier's preferences, should wind force change, or to accommodate a change in the size of the sail. The bolt 70 and respective nut serve as releasable connecting means to connect the supporting means 45 to the respective ski. Security of the connection is enhanced by locating ends of the forward and aft pillars in the respective recesses 74.

The appropriate pairs of openings of the arrays 81 and 82 are selected, depending on the desired spacing between the skis, which determines width of stance of the skier. Preferably, the cleat 90 is positioned on an outboard side of the end portion to facilitate grasping and tensioning of the cords. To connect the apparatus together, the elastic cords 85 and 86 are passed downwardly through the first openings (81.2 and 82.2 in this instance) on the inboard side of the arrays of openings 81 and 82 until the knots 88 contact the cross piece. The cords then pass the edge 54, transversely through adjacent openings between the forward and aft pillars 65 and 66 and the central pillar 68, around the link surface 60, and finally through appropriate second openings in the array (81.4 and 82.4 in this instance) spaced closely to the edge 55 of the datum surface. It is important that the correctly spaced second opening is selected to receive the appropriate cord, so that the cord passes closely around the link surface 60 and immediately into the second opening, i.e. it does not "bridge" across to the opening. The cord is then pulled through the appropriate opening in the cleat 90, and sufficient tension is applied to the cord, before cinching the cord in the cleat.

Thus, the supporting means 45 functions to provide a platform generally parallel to the base of the ski which receives a cross piece to support the cross piece above the ski, to provide clearance for the cross piece to avoid the binding 18. The forward and aft pillars 65 and 66 extend downwardly from the link surface 60 towards the ski 12, and are spaced apart longitudinally to provide a link clearance therebetween to receive the flexible link passing generally transversely through the link clearance. Preferably two separate link clearances are provided so that there is a restriction, i.e. the central pillar 68, between the two separate flexible links, which are maintained longitudinally spaced apart. However, in some applications the central pillar could be eliminated and the forward and aft support pillars 65 and 66 could extend from the link surface 60 towards the base 69, i.e. towards the ski, to provide a single link clearance therebetween.

The degree of cord tension is easily found by experiment, and is important as it determines the degree of "elasticity" of the connection between the ski and the cross piece. Clearly, the greater the tension applied to the cords before cinching, the less elasticity there is in the connection. A wide range of elasticity in this connection can be attained depending on resilience of the cord, thickness of the cord, (which is reduced under tension) and spacing between openings, particularly longitudinal spacing between the arrays of openings 81 and 82. With skill it is possible to set different tensions in the forward and aft cords to attain specific characteristics in the connection. The above connecting procedure is performed for both connecting means at the ski area, which is preferably a frozen lake which is snow covered to provide a relatively flat and slightly soft surface. After both skis are connected to the cross piece, the skier secures the sail rig 14 to the cross piece and secures his boots in the bindings, after which the apparatus is now ready for use. Operation of the apparatus is similar to sail boarding with the added advantage of a relatively stable surface, an increased tolerance to unbalance forces, and improved control of lateral movement in side winds.

An important aspect of the invention relates to several degrees of freedom in the connecting means for connecting each ski to the cross piece. There are two main degrees of freedom which result from the use of a pair of axially spaced elastic links engaging the support member having a flat surface in contact with the cross piece. These two main degrees of freedom relate to rotation of the skis about horizontal and laterally spaced longitudinal axes, which occurs when the skier "edges" his skis, and rotation of the skis about vertical and laterally spaced yaw axes disposed generally normal to bases of the skis, which occurs when turning the skis in the same direction as in a parallel turn. The skis can also be turned slightly in opposite directions which occurs when snow ploughing. The two degrees of freedom are also accompanied by adjustable self-stabilizing or centering forces which tend to return the skis to a neutral position, that is with the ski bases 53 flat or un-edged, and the skis parallel to each other and perpendicular to the cross piece. In the following discussion, for the sake of simplicity, the ski is assumed to move with respect to the cross piece 35 in one degree of freedom only. In practice, it is likely that the ski will tend to move in at least two degrees of freedom, which is acceptable in the present apparatus, and essentially inevitable due to the lack of precision which is inherent when skiing over a surface which usually has irregularities and varying degrees of softness.

Referring to FIG. 5, the ski 12.2 is shown edged on an inside edge 102 on a snow surface 104. When the cross piece is horizontal, i.e. parallel to surface 104, the datum support surface 49 is inclined at an angle 106 to the lower surface 51 of the cross piece, which causes the elastic cord 85 to be stretched, particularly on an inside portion thereof against the edge 55. Interference between the cord 85 and the opening 81.4 essentially prevents outwards lateral movement of the edge 54, although some local distortion of the cord 85 could occur due to slight lateral movement of the support body 47. Clearly, tension in the cord 85 produces a strong centering or returning force on the body 47 tending the return the body to the neutral position with the surface 49 being parallel to the ski base 53. FIG. 5 is shown approaching a normal limit of angulation, and typically the angles 106 will be between 0 and 10 degrees when wind skiing downwind or on most reaches. The angles 106 for each ski will not necessarily be equal, and can be increased when skiing upwind, perhaps up to about 45 degrees for expert skiers, to facilitate upwind positioning. In this manoeuvre, most of a skier's weight is on the ski on an upwind side of the skier, namely the upwind ski, which is positioned more forwardly than the ski on a downwind side of the skier, namely the downwind ski. Clearly, if the skis are angled or "edged" at different angles, bases of the skis are not parallel to each other when viewed from the front or back. Edging as shown in FIG. 5 is used to restrict movement in direction of an arrow 108, that would tend to occur in response to wind force acting in that same direction, when the skier is travelling at an angle to the wind direction, particularly when sailing in a broad reach. Turning is a combination of a normal downhill ski turn and a jibe as used in windsurfing. In a normal turn, the ski on the outside of the turn, namely the outside ski, is turned towards the ski on the inside of the turn, namely the inside ski, and most of the skier's weight is carried on the outside ski until the turn is completed.

Similarly, the ski 12.2 could be rotated relative to the cross piece 35 to be supported on an outside edge 111 which would be required to resist forces in a direction opposite to the arrow 108. Clearly, the ski 12.1 on the opposite side of the cross piece normally performs essentially simultaneous, opposite and parallel movements as in normal skiing. With accurate adjustment of tension in the elastic cords, the centering forces for each ski can be generally equalized, thus facilitating skiing with the bases flat on the snow, which would be necessary when running down wind or in light wind conditions. In fact, if the skier relaxed his/her ankles, there could be sufficient force in the cords 85 and 86 to attain flat bases on the ski with little skill on the part of the skier.

Clearly, the above aspect of the invention is dependent on co-operation between the flat surfaces 49 and 51. For preferred use, at least the edges 54 and 55 should be coplanar, with a central portion of the surface 49 being at least level with the edges 54 and 55, or it could be slightly recessed, as shown in FIG. 5 in broken outline at 49.1, to provide two ridges. In any event, in general the surface 49 should not be strongly curved convex outwardly, otherwise this would produce uncontrolled rocking between the skis and lose some benefits of centering. However, more expert skiers may prefer a slightly convexly crowned surface 49 which would provide fine adjustment of edging of the skis for more expert skiing.

It can be seen that the support body 47 and elastic cords 85 and 86 provides a first centering means for resiliently urging each ski to a first neutral configuration thereof with respect to the cross piece, in which the bases 53 of the skis are disposed generally within a common neutral plane. The supporting means 45 has a generally flat datum support surface 49 spaced from and disposed generally parallel to an adjacent portion of the ski base 53. It can be seen that at least one of the anchoring means, namely the knot 88 or cleat 90, is located on each opposite side of the respective supporting means 45 to receive a portion of the flexible link extending therebetween to generate the first centering force. The first centering force is a rotational force generally about the longitudinal axis of the ski tending to urge an adjacent surface of the cross piece against the adjacent datum support surface. In general, other factors being equal, the minimum spacing between edges of the first and second openings 81.2 and 81.4 is generally equal to the width 58 of the datum surface. It is noted that displacement of the support body from the neutral position to the angle 106 generates a first rotational or stabilizing centering force which acts perpendicularly to the surface 49. However, a centering force could still be obtained if there was a small excess spacing between the openings and the width 58, but if the excess spacing was too large, the centering force would be reduced, which could result in excessive movement between the supporting means 45 and the cross piece. Also, if the width of the cord is reduced excessively under tension, excessive clearance develops in the openings 81 and 82, further aggravating the said excessive movement.

Referring to FIG. 6, the second degree of freedom is provided by the same structure that provides the first degree of freedom, thus resulting in a relatively simple, lightweight structure which combines the two degrees of freedom in an essentially unitary structure. The second degree of freedom relates to rotation of the ski about a generally vertical yaw axis 114 disposed generally normally to the base 53 of the ski.

For simplicity, it is assumed that the ski rotates with respect to the cross piece 35 about the yaw axis 114 in direction of an arrow 116 as shown, which causes the edge 54 of the surface 49 to be forced against the cord 86 passing through the opening 82.4. Similarly, the edge 55 is forced against the cord 85 passing through the opening 81.2. Interference between the cords and the adjacent edges of the openings and support body generates a force in an opposite direction to the arrow 116, thus serving as a second centering or stabilizing force tending to return the support body 47 to a second neutral configuration in which the ski is generally perpendicular to the cross piece as viewed in plan in FIG. 2. Thus the support axis 62 swings from a displaced position 62.1 disposed at a yaw angle 117 to the original aligned position back to the original aligned position of the axis 62. Thus, it can be seen that the second centering force is a rotational force about the yaw axis 114 of the respective ski tending to urge the respective ski to a position disposed generally perpendicularly to the cross piece, so that both skis are urged to be generally parallel to each other. The angle 117 can vary up to a maximum of about 15–20 degrees. The strength of the second centering force is dependent on tension in the cords 85 and 86, and the axial spacing 84 between the arrays 81 and 82. Also, to attain an optimum centering force, spacing between the pairs of openings receiving the cord should be generally equal to the width 58 of the datum surface. For simplicity, the yaw axis 114 is assumed to be stationary with respect to the cross piece 35. Clearly, there is no positively located pivot point controlling location of the axis 114, as this is a theoretical position determined by deflection of the elastic cords 85 and 86 due to a twisting force applied to the ski. In practice, there are likely to be differences in tension between the cords 85 and 86, which with other factors, causes the yaw axis 114 to move or "float" with respect to the cross piece 35, but this is immaterial and a "floating yaw axis" may assist in providing a more natural "feel" when turning the skis.

Thus, it can be seen that the pair of axially spaced, transversely extending elastic cords provides a second centering means for resiliently urging each ski to a second neutral configuration in which the skis are disposed parallel to each other and generally perpendicularly to the cross piece. While in theory, one cord could be used to provide the first centering force, at least two cords are required to attain the second centering force as the spacing 84 between the forward and aft arrays of openings 81 and 82 must be sufficient to generate at least one force spaced from the yaw axis 114 to generate torque required for an adequate second centering force. Consequently, at least an additional pair of anchoring means are provided for each ski connecting means, in which the forwardly disposed pair of anchoring means is disposed axially from a rearwardly disposed pair of anchoring means to provide the axial spacing 84. Also, the anchoring means of each pair is located closely adjacent each side of the supporting means 45 to locate axially spaced portions of the flexible link against each side of the supporting means 45 to generate the second centering force. Thus, the anchoring means permit limited elastic deformation of a portion of the flexible link extending between the anchoring means, but prevent gross movement of the flexible link as a whole. This deformation results in easily adjustable centering forces which tend to restore the skis to a parallel and "flattened" base neutral condition as well as providing shock absorbing properties. This is clearly an advantageous and very simple structure in which movement of the flexible tension link is limited when compared with structure in the German Publication DE 3506-609-A which permits gross movement of the flexible link, i.e. movement of the link as a whole.

From the above, it can be seen that the first and second centering means are combined in generally unitary structure to result in combined centering forces which act simultaneously on the ski tending to maintain the ski bases generally parallel within the neutral plane, and the skis generally parallel to each other. The resilience in the tensioned cords provides excellent shock absorbing capacity between the sail assembly and the skis, which reduces shock loading on the apparatus 16 and the skis, and also risk of injury to the skier.

ALTERNATIVES

The above description shows a preferred embodiment of the apparatus in which the cross piece 35 cooperates with the supporting means 45 which is independent of the toe piece of the bindings 18. Furthermore the supporting means 45 can be located at different locations longitudinally along the ski, which determines location of the mast 21 and thus varies responsiveness and control characteristics of the apparatus. An alternative embodiment of the invention is suitable with specific types of conventional ski binding toe pieces only, and uses the toe pieces as a substitute for the supporting means 45 as previously described. Each toe piece is used as a projection to cooperate with the elastic cords. However, as most toe pieces are essentially fixed longitudinally to the skis, there is no simple provision for longitudinal adjustment of the cross piece with respect to the skis, and thus, because the location of the mast is determined by location of the toe piece, this may not be the most desirable mast location for all skiers.

Figure 7:
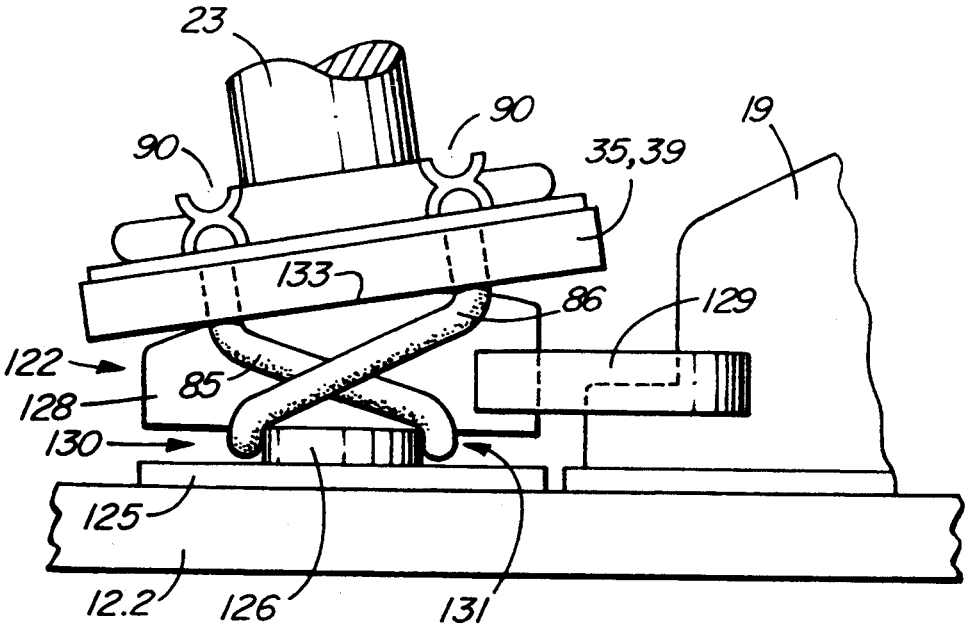
FIG. 7 is a simplified fragmented side elevation of an alternative embodiment of the invention in which the apparatus is shown fitted to a suitable prior art ski binding toe piece, thus eliminating support portions of the invention.
Figure 8:
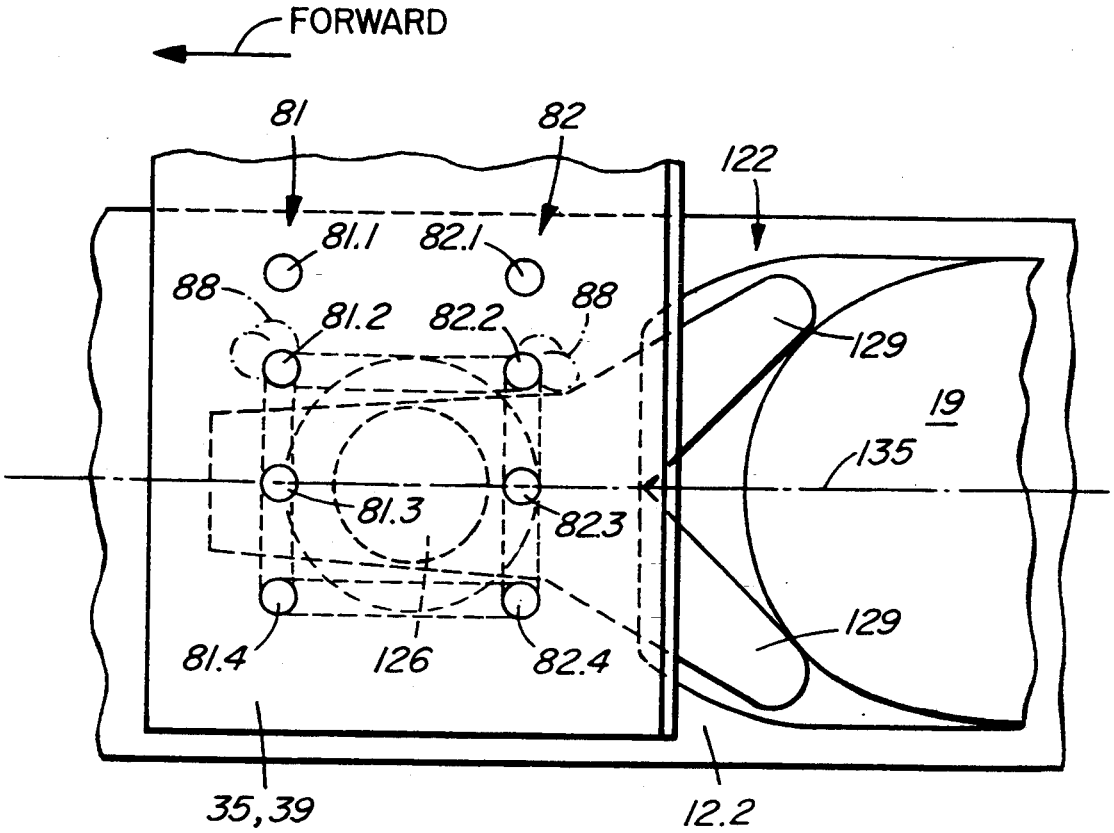
FIG. 8 is a simplified fragmented top plan of the alternative of FIG. 7.

FIGS. 7 and 8

The ski 12 has a conventional toe piece 122 of a particular type of ski binding which is suitable for use with the present invention as follows. The toe piece has a toe piece base 125 carrying a toe piece pivot pillar 126 extending upwardly from the base to support a toe piece body 128 thereon. Tangs 129 extend rearwardly from the body to engage the toe of the ski boot 129, and are spaced well above the upper surface of the ski. The toe piece body has forward and aft portions which extend forwardly and aft of the pillar 126 to provide overhangs with forward. and aft clearances spaces 130 and 131 respectively on opposite sides of the pillar 126. The overhangs provide adequate clearance to receive the elastic cords passed therethrough and have sufficient length to essentially prevent inadvertent slipping of the elastic cords from underneath the toe piece. The body 128 of the toe piece has a generally flat upper surface 133 which has sufficient length along the axis of the ski to retain the cross piece 35 thereon with essentially no rocking of the cross piece forward and aft of the ski, or laterally of the ski. The surface 133 can be inclined slightly downwardly and forwardly but should not be excessively convex upwardly. Also, side walls of the body 128 should be generally parallel to each other when viewed from above as in FIG. 8, to assist in maintaining the elastic cords in place. In addition, the sidewalls of the toe piece must be locatable closely adjacent and between cooperating pairs of openings of the forward and aft array of openings 81 and 82 in the end portion 39. If the skis have toe pieces of this general type with the specified limitations, the supporting means 45 can be eliminated and the cross piece connected directly to the toe pieces using the elastic cords as will be described. Suitable toe pieces which can be used with the present cross piece 35 include SALOMON (Trade Mark) Model Numbers 977,777, 677,577 and also the Driver Equipe Model (Trade Mark).

The forward and aft arrays of openings 81 and 82 in the left hand end portion of the cross piece are preferably arranged so that a longitudinal axis 135 of the ski generally coincides with one of each of the forward and aft openings. Also, at least one forward and aft opening is closely adjacent inboard and outboard sidewalls of the toe piece body 128, as seen in FIG. 8 so as to generate forces associated with the first and second centering means. In this particular instance, the forward and aft openings 81.3 and 82.3 are generally coplanar with a longitudinal axis 135 of the ski, the forward and aft openings 81.2 and 82.2 are adjacent an inboard sidewall of the toe piece, and the openings 81.4 and 82.4 are adjacent an outboard sidewall of the toe piece.

The forward elastic cord 85 can be essentially similar to that used in the first embodiment of the invention, and is threaded through the opening 81.2 so that the knot 88 (broken outline) is drawn against the end portion 39. The outer end portion is then passed aft and alongside the toe piece pivot pillar 126, transversely across to pass around the pillar, and then forwardly to pass upwardly through the opening 81.4 after which is retained in the cleat 90, not shown. Similarly, the aft elastic cord 86 is passed downwardly through the aft opening 82.2 until the knot 88 contacts the end portion 39. The cord 86 is then passed forwardly and alongside the pillar 126, around and transversely across a forward portion of the pillar and then aft to pass through the opening 82.4 and the cleat, and to be retained by the cleat. Thus, the forward and aft elastic cords are passed transversely around the aft and forward portions of the pillar respectively, so as to completely encircle the pillar at least once, to apply opposing aft and forward forces respectively, and to draw the cross piece 35 downwardly onto the toe piece body 128. Clearly, the clearance spaces 130 and 131 function equivalently to the link clearance of the supporting means 45. Also, the pivot pillar 126 functions similarly to the central pillar 68 to separate the elastic cords longitudinally so as to generate the second self-centering force. Because the elastic cords pass around lower corners of the ski toe pieces, there is a risk that the cords will be subjected to premature abrasion, with a risk of either weakening the cords, or severing them totally. To reduce this risk, portions of the cords can be fitted inside lengths of tough but flexible plastic sleeves which freely enclose the elastic cords where they pass around the toe pieces, so as to protect the cords from abrasion when passing around edges of the toe pieces.

It can be seen that the toe piece serves as a projection extending from a respective ski as a substitute for the supporting means 45 of FIGS. 1–6, so as to function essentially equivalently, but with the limitations as discussed above. Thus, it can be seen that the flexible link of each connecting means extends generally transversely between the anchoring means of the cross piece. The links are engageable with a respective projection extending from a respective ski to pass around the projection to draw the projection resiliently against the respective end portion of the cross piece. The links permit limited rotation relative to the cross piece about a longitudinal ski axis of each ski, and about a yaw axis of each ski disposed perpendicularly to a base of the respective ski. It can be seen that the projection extending from the respective ski is either a toe piece of a ski binding, or a removable supporting means 45 as described above. It is essential that both the toe piece and the supporting means 45 have a link clearance to receive the flexible tension link passing therethrough generally transversely of the longitudinal axis of the respective ski so as to provide the retaining force for holding the cross piece and toe piece or supporting means together. Clearly, characteristics of the alternative structure using the toe piece are less controllable or predictable than when using the supporting means, because the toe piece is not specifically designed for the present purpose. However, a suitable toe piece could be designed to function in this application as well as the supporting means 45.

While specific embodiments of the invention have been described and illustrated, such embodiments should be considered illustrative of the invention only and not as limiting the invention as construed in accordance with the accompanying claims.

What is claimed is:

1. An apparatus for securing to a pair of skis, the apparatus comprising:

(a) a cross piece for extending transversely between the pair of skis which skis can be disposed generally parallel to a main longitudinal axis, the cross piece having a central portion disposed between a pair of opposite end portions, the central portion being intersected perpendicularly by the longitudinal axis and having sail connecting means for connecting to a sail assembly, and (b) ski connecting means for connecting each ski to a respective opposite end portion of the cross piece, each ski connecting means comprising at least one resilient flexible link, and at least one pair of anchoring means for anchoring at least two portions of the flexible link to the respective end portion of the cross piece, the anchoring means permitting limited elastic deformation of a portion of the flexible link extending between the anchoring means but preventing gross movement of the flexible link as a whole, the portion of the flexible link extending between the anchoring means of each connecting means being engageable with a respective projection extending from a respective ski to pass around the projection to draw the projection resiliently against the respective end portion of the cross piece while permitting limited rotation of the respective ski relative to the cross piece about a longitudinal ski axis of each ski and also limited rotation of the respective ski about a yaw axis of each ski disposed perpendicularly to a base of the respective ski.

2. An apparatus as claimed in claim 1, in which each ski connecting means further comprises:

(a) a first centering means for resiliently urging each ski to a first neutral configuration thereof with respect to the cross piece, in which the bases of the skis are disposed generally within a common neutral plane.

3. An apparatus as claimed 1, in which each ski connecting means further comprises:

(a) a second centering means for resiliently urging each ski to a second neutral configuration thereof, in which the skis are disposed parallel to each other and perpendicularly to the cross piece.

4. An apparatus as claimed in claim 1, in which:

(a) a portion of the flexible link of each connecting means extends generally transversely of the ski, and (b) the projection extending from the respective ski is a toe piece of a ski binding mounted on the respective ski, portions of the toe piece being spaced from the ski to provide clearance to accept the flexible link extending generally transversely therethrough.

5. An apparatus as claimed in claim 1, further comprising:

(a) a supporting means for each ski for supporting the cross piece on the respective ski to serve as the projection extending from the respective ski, the supporting means having a link clearance to receive the flexible tension link passing therethrough generally transversely of the longitudinal axis of the respective ski.

6. An apparatus as claimed in claim 1, further comprising:

(a) a supporting means for each ski for supporting the cross piece on the respective ski to serve as the projection extending from the respective ski, the supporting means having a datum support surface spaced from and disposed generally parallel to an adjacent base portion of a ski base, (b) at least one of the anchoring means being located on each opposite side of the respective supporting means to receive a portion of the flexible link extending generally transversely therebetween to generate a first centering force, which is a rotational force about the longitudinal axis of the ski tending to urge an adjacent surface of the cross piece against the adjacent datum support surface to provide the first centering means for the skis to urge the bases of the skis into the common neutral plane.

7. An apparatus as claimed in claim 1, further comprising:

(a) a supporting means for each ski for supporting the cross piece on the respective ski to serve as the projection extending from the respective ski, the supporting means having a pair of generally longitudinally extending support edges spaced laterally apart with respect to the main longitudinal axis, (b) at least one additional pair of anchoring means to provide at least two pairs of anchoring means for each ski connecting means, in which a forwardly disposed pair of anchoring means is disposed axially from a rearwardly disposed pair of anchoring means of each ski connecting means, with a portion of the flexible link extending generally transversely between each pair of anchoring means, one anchoring means of each pair being located closely adjacent each side of the supporting means to locate axially spaced portions of the flexible link against each side of the supporting means to generate a second centering force which is a rotational force about the yaw axis of the respective ski tending to urge the respective ski to a position disposed generally perpendicularly to the cross piece, so that both skis are urged to be generally parallel with each other.

8. An apparatus as claimed in claim 2, further comprising:

(a) a second centering means for resiliently urging each ski to a second neutral configuration, in which the skis are disposed parallel to each other and perpendicularly to the cross piece, (b) the first and second centering means being combined in a generally unitary structure to result in combined centering forces which act simultaneously on the ski tending to maintain the ski bases generally within the neutral plane, and the skis generally parallel to each other.

9. An apparatus as claimed in claim 6, in which each supporting means has a link support surface spaced from an adjacent upper surface of the respective ski to provide a link clearance between the upper surface of the ski and the supporting means to receive the flexible link passed generally transversely through the link clearance.

10. An apparatus as claimed in claim 9, in which the link surface is curved and extends between generally axially disposed edges of the datum support surface to receive the link means passing smoothly therearound between the anchor means on opposite sides of the supporting means.

11. An apparatus as claimed in claim 5, in which each supporting means comprises:

(a) a support body of semi-cylindrical cross-section, with a generally flat diametrically disposed datum support surface, and a semi-cylindrical link surface generally concentric with a longitudinally extending support axis, (b) forward and aft support pillars extending from the link surface towards the ski, the forward and aft support pillars being spaced apart longitudinally to provide a link clearance therebetween to receive the flexible link passing generally transversely through the link clearance.

12. An apparatus as claimed in claim 11, in which each supporting means further comprises:

(a) a support base securable adjacent an upper surface of the respective ski, (b) releasable engagement means for releasably connecting the support body to the respective ski.

13. An apparatus as claimed in claim 5 further including:

(a) adjustment means to permit longitudinal adjustment of the supporting means relative to the respective ski.

14. An apparatus as claimed in claim 13 in which the adjustment means comprises:

(a) a support plate securable to an upper surface of the ski, the support plate having a plurality of longitudinally spaced apart engagement means, (b) the supporting means has a releasable engagement means complementary to the engagement means on the support plate, to permit the supporting means to be located at several longitudinally spaced apart positions along the ski as desired.

15. An apparatus as claimed in claim 1, in which the anchor means for one link of a ski connecting means comprises:

(a) the end portion of the cross piece having a first link opening to receive the link passing therethrough, (b) a first end portion of the link having a first stop which is prevented from passing through the first link opening, (c) link retaining means for releasably retaining an opposite second end portion of the link to permit adjustment of tension of the link.

16. An apparatus as claimed in claim 15, in which:

(a) the link retaining means is a cleat which interferes with the second link end portion to releasably retain the link thereagainst, (b) the end portion of the cross member has a second link opening to receive the second end portion of the link passing therethrough, the cleats being held against the second end portion adjacent the link opening.

17. An apparatus as claimed in claim 16, in which:

(a) the end portion of the cross piece has a plurality of openings therein disposed longitudinally and transversely of the main longitudinal axis, so as to permit lateral movement of the anchor means with respect to the main longitudinal axis, so as to permit adjustment of spacing between the skis with respect to each other.

18. An apparatus as claimed in claim 5, in which:

(a) the supporting means has a width as measured transversely of the ski, and (b) each end portion of the cross piece is provided with at least one cooperating pair of openings, the openings of each cooperating pair being spaced transversely apart with respect to the ski at a spacing approximately equal to the width of the support means to receive the flexible link passing around the support means and through the openings to respective anchoring means.

19. An apparatus as claimed in claim 18, in which:

(a) each end portion of the cross piece is provided with forward and aft cooperating pairs of openings, the openings of each pair being spaced apart transversely with respect to the ski at the adjacent width of the supporting means, and the openings of the pairs being aligned longitudinally with respect to the ski.

20. An apparatus as claimed in claim 18, in which:

(a) each end portion of the cross piece is provided with a plurality of openings disposed longitudinally and transversely with respect to the ski, so as to permit lateral movement of the anchoring means with respect to the ski so as to adjust spacing between skis with respect to each other.

* * * * *
* * * * *